United States Patent [19]

Kuwertz

[11] 4,038,925

[45] Aug. 2, 1977

[54] COUPLING ARRANGEMENT FOR TOWING CONVEYOR

[75] Inventor: Erich Kuwertz, Trippstadt, Germany

[73] Assignee: Pfalzstahlbau GmbH., Pirmasens, Pfalz, Germany

[21] Appl. No.: 612,002

[22] Filed: Sept. 10, 1975

[30] Foreign Application Priority Data

Sept. 14, 1974 Germany ..... 2444127

[51] Int. Cl.[2] ..... B61J 3/00

[52] U.S. Cl. ..... 104/88; 104/91; 104/172 S

[58] Field of Search ..... 104/88, 172 S, 89, 91, 104/96, 130

[56] References Cited

U.S. PATENT DOCUMENTS

| | | | |
|---|---|---|---|
| 3,044,416 | 7/1962 | Reibel et al. | 104/172 S |
| 3,353,499 | 11/1967 | Sutherland | 104/172 S |
| 3,559,586 | 2/1971 | Follrath | 104/172 S |
| 3,906,864 | 9/1975 | Kuwertz | 104/172 S |

*Primary Examiner*—Robert J. Spar
*Assistant Examiner*—Carl Rowold
*Attorney, Agent, or Firm*—Robert H. Jacob

[57] ABSTRACT

A coupling arrangement for towing conveyors comprising a towing chain having catchers, a track disposed below the towing chain, running carts equipped with two running mechanisms rolling on the track, said catchers having movable coupling parts and said running carts having coupling elements securely disposed on said running mechanisms cooperating with said coupling parts, where the coupling parts disposed on the catchers of the towing chain comprise a housing in which a catcher finger and a setting lever which is in operative relationship thereto are pivotally mounted for movement in opposite directions about horizontal axes in a manner that the setting lever normally holds the catcher finger in its position of engagement and for a raised position of a run up part provided at the rear running mechanism of each running cart with a local running mechanism as seen in the direction of feed causes a pivoting upwardly of the catcher finger, while the roller carriers' supports of the running cart are designed as coupling parts associated with the running carts and carry curved members which are formed as roller caps, while the roller cap which is forward in the direction of feed has a rounded portion in front and a vertical abutment in back, whereas the roller cap that is rearward has vertical forward and rear sides, while furthermore the setting lever that simultaneously serves as latch lever has a nose which engages and stops the carry along finger in its vertical position and in its raised position frees the same for upward pivotal movement in opposite direction to the feed direction, the latch lever being releasable upwardly about its pivot axis, its lower position being secured by a pin or the like and an intermediate lever for establishing an operating connection between the drop lever and the latch lever.

2 Claims, 1 Drawing Figure

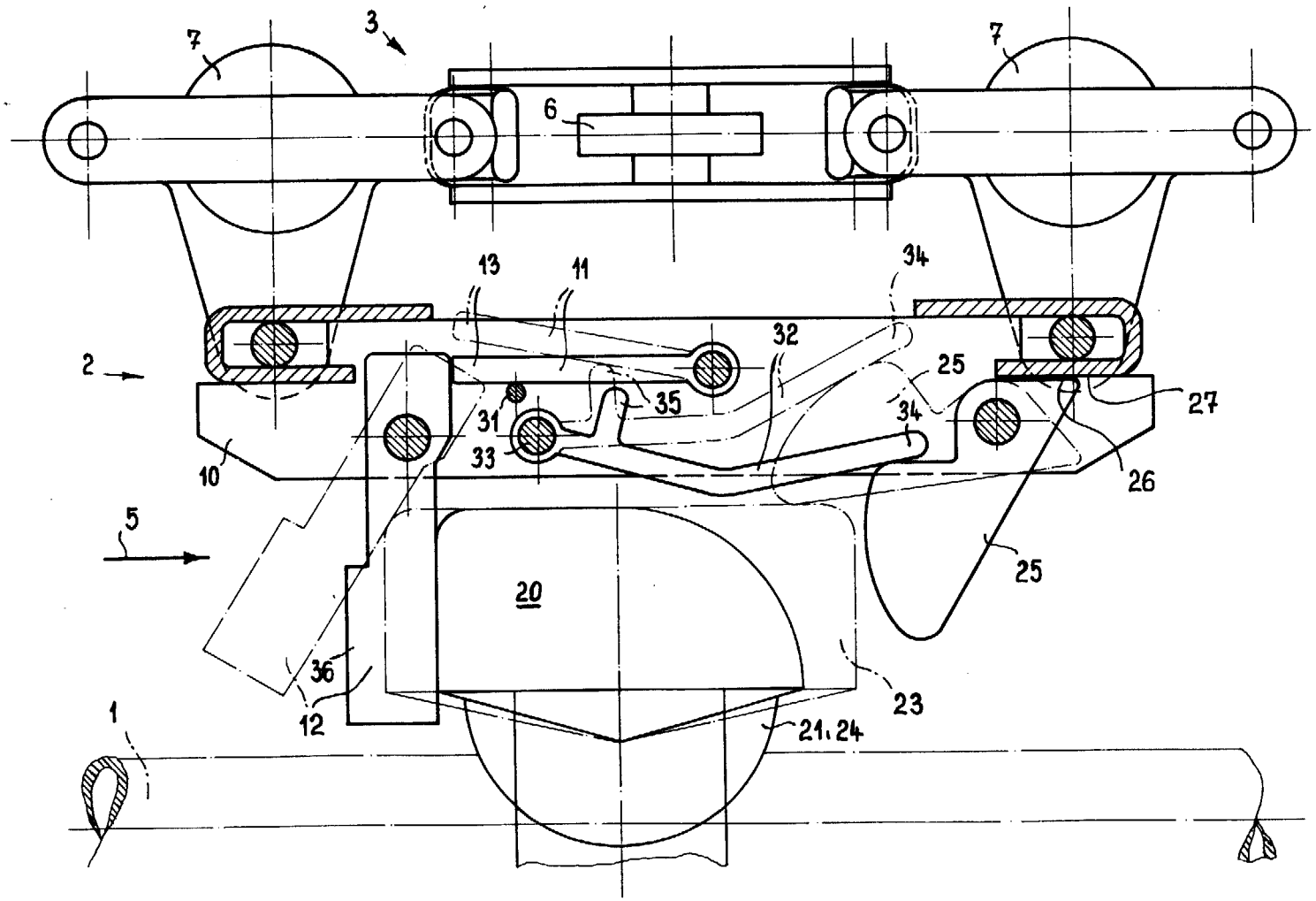
27
26
25
7
25
34
34
23
21,24
32
35
11
6
20
13
31
33
3
36
12
7
10
2
5
1

COUPLING ARRANGEMENT FOR TOWING CONVEYOR

The present invention relates to a coupling arrangement for endless towing conveyors having running carts equipped with two drivers disposed below a towing chain therefor, where the movable coupling parts are fixedly arranged on the drivers of the driving chain and the coupling parts of the carts cooperating therewith are fixedly disposed on the drivers while furthermore the coupling parts arranged on the drivers of the driving chain comprise a housing in which one catching finger and a setting lever operating in connection therewith are pivotally supported for opposite movement about horizontal axes, in a manner that the setting lever normally holds the catching finger in its position of engagement and in the raised position of an approach part provided on the running mechanism of each running cart causes pivoting of the catcher finger upwardly which causes in cooperation with a local or a rearward running mechanism of each running cart as related to the direction of feed while in accordance with the main patent the roller supports of the running carts are simultaneously designed as the coupling parts or mechanisms and carry for this purpose curved members which are in the form of roller caps, while the roller cap which is forward in the feeding direction has a rounded portion in front and is equipped in the rear with a vertical abutment surface, whereas the roller cap that is in the rear relative to the direction of feed has vertical front and back sides, while furthermore the setting lever serving simultaneously as latch lever has a nose that stops the catching finger above its axis of rotation engaging the same in vertical position and releases the same upwardly above its axis of rotation and in its own raised position releases the same upwardly for pivotal movement in opposite direction to the feed direction, while the latch lever is provided at its lower side with a rounded portion of the front roller cap of the running carts with a bight corresponding thereto and the side of the catch finger that faces the nose of the latch lever is likewise provided with a bight into which the nose enters in order to release the catch finger.

The towing conveyors for which this coupling arrangement is intended are frequently built in such a manner that the towing chain and the suspended track for the running carts that are equipped with two running mechanisms have to overcome upward and downward slopes while usually upward inclines as well as also declines extend at an angle of 30° relative to the horizontal. With horizontal straight running of the running carts as well as also while overcoming an incline in the forward direction there are no difficulties or problems. It is different, however, while negotiating downward stretches. Here the running carts can become released from the coupling with the towing chain and run ahead. To be sure thay are again caught at the end of the downward stretch, the coupling with the towing chain is restored. Nevertheless, this undesired release of the running carts can result in complications.

An older proposal of the inventor was to construct the coupling mechanism in such a manner that the latch lever is supplemented by a further drop lever pivotable about a horizontal axis in the housing, its lower end cooperating with roller caps of the running carts and having at an end of the latch lever associated with the running cart a pin cooperating with a running cart and an end side cooperating with an abutment on the housing above its pivot axis. This coupling arrangement operates faultlessly. It has been found however, that particularly after long use, there result deviations in the length of the latch lever and in the bearing of the catcher finger which may exceed the range of tolerances within the limits of which the safe functioning is assured. Now these problems can be readily solved by suitable material means and extraordinary structural design, for example, of the pivot bearings of the different levers of the coupling arrangement. This however would involve an expense that cannot be accepted.

The invention is based on the problem of so designing the coupling mechanism of the main patent that also after long wear exposed operation the security of operational reliability is completely safeguarded. In this connection the advantages of the main patent and in accordance with the further mentioned patent of addition are to be maintained; particularly it is to be insured that the force for releasing the coupling operation must only be small.

Beginning with a coupling mechanism in accordance with the main patent such as initially described, the invention solves the problem in that the latch lever that cooperates with the catcher finger can be unlinked upwardly, its lower latching position is insured and an intermediate lever for establishing an operative connection between the drop lever and the latch lever is provided.

By means of the aforementioned construction and arrangement of the latch lever it is insured that also under extremely extensive wear phenomena the latching effect in the lower position of the latch lever for the catcher finger is always provided. Independently of any wear phenomena of the pivot bearing of the catcher finger this applies particularly independently of any wear phenomena. By the intermediate lever disposed between latch lever and drop lever favorable lever ratios are insured so that only very small forces are necessary for the release of the coupling operation.

The catcher finger may be designed in a manner displacing the center of gravity from the vertical under its center of gravity towards the rear (related to the direction of feed). Thereby the function of the coupling mechanism is also improved and supported.

In the drawing an embodiment of the coupling arrangement for towing conveyors in accordance with the invention is illustrated schematically which in the following specification is explained more in detail.

Upon the tracks of the suspension rail 1 indicated only in dot and dash lines the running carts move in the direction of the arrow 5. These running carts are not specifically illustrated, merely the roller caps 20 of the forward roller 21 as well as (again in dot and dash lines) the roller cap 23 of the rearward roller 24 are shown. These running carts are moved along by the catchers 2 of the towing chain 3 which may be constructed in the manner of a short joint chain with guide rollers 6 and 7.

Catchers 2 of the towing chain 3 have a housing 10 between the vertical side walls of which a latch lever 11, a catcher finger 12 and a drop lever 25 are pivotally journalled about horizontal axes. The latch lever 11 stops the catcher finger 12 with its free end 13 in its vertical downwardly pointing position, as long as the end is in its lower horizontal position illustrated in solid lines, secured by means of a pin 31 or the like. If the latch lever 11 is raised to the position shown in dot and dash lines, it frees the upper end of the catcher finger 12, so that it also can swing out and free the roller cap 20 of the running cart and slides over it.

In order to retain the advantage of the small expenditure of forces a further intermediate lever 32 is provided which is pivotally journalled about an axis 33, cooperates with its free end 34 with the drop lever 25 and moves the latch lever 11 with its lateral extension 35 into its position illustrated in dot and dash lines.

The drop lever 25 is of course provided with an end surface 26 which cooperates with a corresponding abutment 27 in the housing 10 and limits the pivotal movement of the drop lever downwardly. In its position indicated in dot and dash lines, the drop lever 25 swings the free end 34 of the intermediate lever 32 upwardly (likewise shown in dot and dash lines) which in its turn raises the latch lever 11 by means of extension 35. The catcher finger 12 can swing out of its vertical position.

The catcher finger 12 can, as illustrated, be provided with an extension 36 on its side opposite from the direction of feed with the help of which the center of gravity is displaced rearwardly out of the vertical below the pivot axis of the catcher finger so that the latch member 11 can drop back unimpededly from its dot and dash line position into the basic position after the roller cap 20 has been released from the catcher finger 12.

Having now described my invention with reference to the embodiment illustrated in the drawing, what I desire to protect by letters patent is set forth in the appended claims:

1. In accordance with the invention a coupling arrangement for towing conveyors is provided comprising a towing chain having catchers, a suspended track disposed below said towing chain, running carts equipped with two running mechanisms rolling on said track, said catchers having movable coupling parts and said running carts having coupling elements securely disposed on said running mechanisms cooperating with said coupling parts, where further the coupling parts disposed on the catchers of the towing chain comprise a housing in which a catcher finger and a setting lever which is in operative relationship thereto are pivotally mounted for movement in opposite directions about horizontal axes in a manner that the setting lever normally holds the catcher finger in its position of engagement and for a raised position of a run up part provided at the rear running mechanism of each running cart with a local running mechanism as seen in the direction of feed causes a pivoting upwardly of the catcher finger, while the roller carriers' supports of the running cart are designed simultaneously as coupling parts associated with the running carts and carry curved members for this which are formed as roller caps, while the roller cap which is forward in the direction of feed has a rounded portion in front and a vertical abutment surface in back, whereas the roller cap that is rearward relative to the direction of feed has vertical front and rear sides, while furthermore the setting lever that simultaneously serves as latch lever has a nose which engages and stops the carry along finger in its vertical position and in its raised position frees the same for upward pivotal movement in opposite direction to the feed direction, said latch lever being releasable upwardly about its pivot axis, its lower position being secured by a member such as a pin and an intermediate lever for establishing an operating connection between said setting lever in the form of a drop lever and said latch lever.

2. Coupling arrangement in accordance with claim 1, where the carry along finger is provided with an extension at the side opposite from the direction of feed.

* * * * *